United States Patent [19]

Muller

[11] 4,201,635

[45] May 6, 1980

[54] METHOD AND APPARATUS FOR CARRYING OUT AN ELECTROLYSIS PROCESS

[75] Inventor: Klaus Müller, Baden, Switzerland

[73] Assignee: BBC Brown Boveri & Company Limited, Baden, Switzerland

[21] Appl. No.: 966,659

[22] Filed: Dec. 5, 1978

[30] Foreign Application Priority Data

Dec. 21, 1977 [CH] Switzerland ..... 15757/77

[51] Int. Cl.[2] ..... C25B 15/00; C25C 7/00; C25D 21/00; C25F 7/00

[52] U.S. Cl. ..... 204/1 R; 204/DIG. 5; 204/212; 204/228; 204/242; 204/273

[58] Field of Search ..... 204/DIG. 5, 1 R, DIG. 3, 204/212, 273, 228, 242; 429/10

[56] References Cited

U.S. PATENT DOCUMENTS

| | | | |
|---|---|---|---|
| 2,710,371 | 6/1955 | Baensch | 429/10 X |
| 3,493,436 | 2/1970 | Johnsen | 429/10 |
| 3,522,162 | 7/1970 | Davies | 204/180 |

FOREIGN PATENT DOCUMENTS

| | | | |
|---|---|---|---|
| 54986 | 4/1967 | Fed. Rep. of Germany | 204/DIG. 5 |
| 454619 | 3/1975 | U.S.S.R. | 429/10 |

OTHER PUBLICATIONS

Carl Hering, American Electrochem. Soc., Apr. 30, May 1, 2, 1908.

*Primary Examiner*—G. L. Kaplan
*Attorney, Agent, or Firm*—Oblon, Fisher, Spivak, McClelland & Maier

[57] ABSTRACT

An electrolysis process in which the source of the voltage difference between the anode and the cathode of the electrolysis cell is an electromotive force. The electromotive force is produced in the electrodes by introducing a magnetic field into the electrolysis cell while mounting the electrodes on a conducting element. Movement of the conducting element or magnet, or alternating the magnetic field then creates the necessary electromotive force. Movement of the conducting element may be caused by the flow of electrolyte. Several conducting elements may be contained in each cell.

31 Claims, 10 Drawing Figures

METHOD AND APPARATUS FOR CARRYING OUT AN ELECTROLYSIS PROCESS

BACKGROUND OF THE INVENTION

1. Field of the Invention

The present invention is concerned with a method for carrying out an electrolysis process in an aqueous or organic solution or in a melt.

The invention is also concerned further with an apparatus for carrying out the method.

2. Description of the Prior Art

Electrolysis processes along with suitable apparatus necessary for carrying them out are known in the technology in numerous variants. Examples are electroplating, i.e. the application of galvanic coatings to metallic and nonmetallic surfaces, and the countless methods of metal extraction and metal refining both in aqueous solution and in the melt. Further, electrolysis finds application in organic and inorganic chemistry for the purification of liquids, especially waste liquors and waste water, where in most cases harmful substances in solution must be precipitated or separated by ion discharge or a synthesis carried out. The carrying out of the method and the equipment and installations required are known from the literature (e.g. C. L. Mantell: "Electrochemical Engineering", McGraw Hill Book Company Inc., New York/Toronto/London, 1960; R. W. Houghton and A. T. Kuhn: "Mass-transport Problems and Some Design Concepts of Electrochemical Reactors", Journal of Applied Electrochemistry 4, 1974, pp. 173–190; P. M. Robertson, F. Schwager and N. Ibl: "A New Cell for Electrochemical Processes", Journal Electroanal. Chemistry 65, 1975, pp. 883–900; P. M. Robertson, N. Ibl: "Electrolytic Recovery of Metals from Waste Waters with the 'Swiss-roll' Cell", Journal of Applied Electrochemistry 7, 1977, pp. 323–330; P. Gallone: "Achievements and Tasks of Electrochemical Engineering", Electrochimica Acta 22, 1977, pp. 913–920). The required cell voltages range from a few tenths of a volt to a few volts, and in exceptional cases ten times higher, while the current strengths can amount to from a few mA to a hundred kA and more. In all the aforementioned examples of application, the potential difference needed for the electrolysis cells is obtained from an external source of electrical energy and impressed on the electrodes via suitable fixed, detachable or movable contact systems. The contact points and current leads of the electrolysis installations in general constitute important components determining both method and construction. At different times electrolysis cells with moving, in particular rotating, electrodes also have been designed for both industrial electrochemistry (e.g. in cadmium extraction) and laboratory purposes.

All conventional electrolysis methods and the corresponding equipment for carrying them out find themselves confronted with the intricate problem of energy input, which is more critical with higher desired cell outputs and higher current strengths. This holds true quite generally for all methods regardless of whether fixed, movable or detachable current leads or even rotating electrodes are provided. In the case of the latter the advantages of the favorable conditions created by the relative motion between electrodes and electrolyte can often not, or only partly, be made use of, since a constant and controlled energy input and potential maintenance is practically impossible with sliding contacts. This disadvantage is more important the higher the requirements on selectivity desired from the process side.

SUMMARY OF THE INVENTION

The object of the present invention is to offer an electrolysis method as well as a means for carrying it out, wherein a completely contact-free power input to the electrolysis cell and the electrolyte is guaranteed and the simple regulation of, and constant value of, the electrode potentials is made possible.

This is achieved by the invention in that the cell voltage between anode and cathode necessary for the electrolysis is generated in accordance with the dynamoelectric principle with the help of a magnetic field and an electron conductor in the cell itself, the magnetic field and conductor moving relative to one another, and in that the electrolysis is carried out in the absence of external current supply to the electrodes.

According to the invention, the apparatus for carrying out the method is characterized by the fact that there are provided an electrolysis receptacle, an electrolyte, at least one anode-cathode pair and an electron conductor arrangement, plus at least one magnet body, as well as at least one rotary drive device.

The guiding idea for the method of the invention is to conduct the electrolysis process in such a way that a completely closed current loop is formed inside the electrolysis cell, so that external current supply to the electrodes can be totally dispensed with. The arrangement of the invention is distinguished by the fact that it is equipped with means for the generation of its own electromotive force by induction. The mechanism necessary for this simultaneously serves for intermixing, homogenizing, circulating and possibly pumping the electrolyte.

BRIEF DESCRIPION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
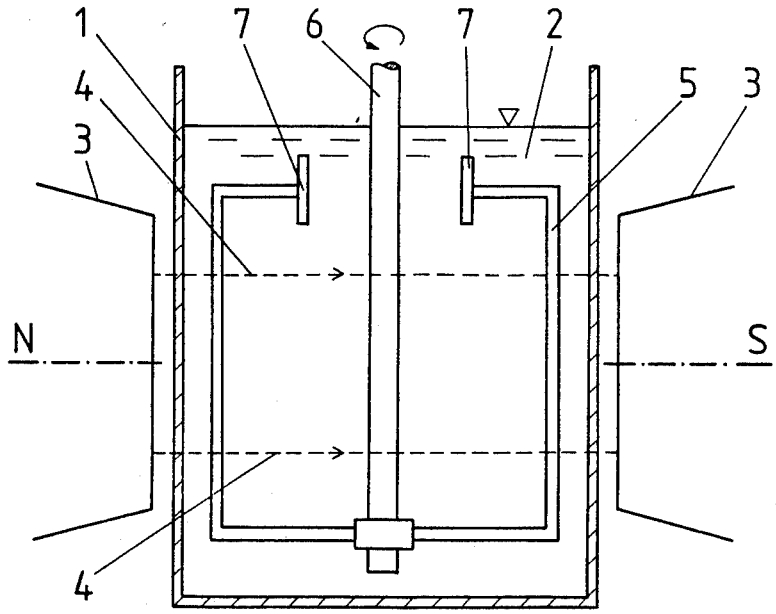
FIG. 1 shows a conductor arrangement in the form of a single rotating open wire loop.

In FIG. 1 an arrangement with a simple conductor in the form of an open wire loop is schematically represented. The cylindrical electrolysis receptacle can be a cell for metal extraction or refining or an electrochemical reactor. Preferably, it consists of a nonconducting corrosion-resistant material, but it can also be a concrete, stoneware or wood container lined with sheet metal (e.g. rolled lead). The electrolyte 2 can be introduced into the receptacle 1 discontinuously in batches which are intermittently emptied out, or it can flow continuously through the receptacle. The receptacle 1 is situated between the poles 3 (symbolized by "N" and "S") of an electromagnet or permanent magnet in such a manner that the field lines 4 pass through the electrolyte 2 and the receptacle 1 essentially diametrically and parallel to a diameter of the receptacle. Immersed in the electrolyte 2 is a rectangular open conductor loop 5 with electrodes 7 at its ends and attached to a vertical shaft 6 of insulating material. Obviously, the conductor loop 5 must also be electrically insulated from the electrolyte. The conductor loop 5 is caused to rotate via the shaft 6 by means of a rotary device not shown here, whereby electromotive forces are induced in the vertical sections of the loop by the dynamo-electric principle. If the magnetic field is stationary and fixed in space, an ac voltage is induced which is available at the electrodes 7 for electrolytic processes. Since numerous electrolytic reactions are direction-dependent, and thus only partially reversible, at least within certain potential differences, the arrangement described here can still be applied to many processes. Since in this case the reactions at the anode and cathode proceed at unequal rates, a rectification effect is noticeable. Under these conditions there are deposited on whichever electrode is acting as cathode e.g. metals which are only partially or indeed not at all redissolved during the succeeding half-period. In this manner both electrodes 7 can be utilized for reactions. A further possibility for achieving a rectification effect consists in the asymmetric design of the electrodes 7, where e.g. the one electrode is made large in area while the other is point-like. Different materials can also be used, the asymmetry being achieved through polarization and overvoltage effects, among others.

The cell in FIG. 1 can also be reversed, since the induction calls only for relative motion between conductor and magnetic field. Thus the former can stand still in space while the latter rotates. For this one can either mechanically rotate the magnet system or by a suitable coil arrangement provide for only the magnetic field lines to change their position and direction in space, while the magnet itself is not moved. Naturally, the conductor and magnetic field can also be simultaneously subjected to a rotary motion, preferably in opposite directions.

If the rectification effect discussed above is not sufficient or is entirely absent, then the asymmetry can be obtained by building in a rectifier, for instance a semiconductor diode, in the horizontal branch of the conductor loop 5.

Another possibility is to replace the fixed stationary magnetic field with an alternating magnetic field and have the conductor loop 5 rotate in time with this alternating field, i.e. with a synchronized rate of rotation.

It must then be assured by suitable coordination that either the plane of the conductor loop 5 at the instant the magnetic flux goes through zero is perpendicular to the magnetic N-S axis and essentially only an EMF of rotation (dc-machine principle) is induced, or that the plane of the conductor loop 5 at the instant the magnetic flux goes through zero lies in the magnetic N-S axis and essentially only an EMF of transformation (transformer principle) is induced.

A further process procedure involves the superposition of several stationary and nonstationary or moving magnetic fields. It is possible, for example, by use of a rotating field, where the magnetic field lines 4 rotate in space, to exert a torque on the conductor loop 5; an external drive mechanism can then be dispensed with. There is then available at the electrode 7 an EMF of rotation corresponding to the slip frequency and essential proportional to this and which can, if necessary, be intensified by the superposition of an additional EMF induced by a constant or alternating magnetic field. By suitable combination of several such fields it is possible to achieve a sufficiently high degree of asymmetry for the electrolysis so that essentially at least a pulsating direct current is established.

Figure 2:
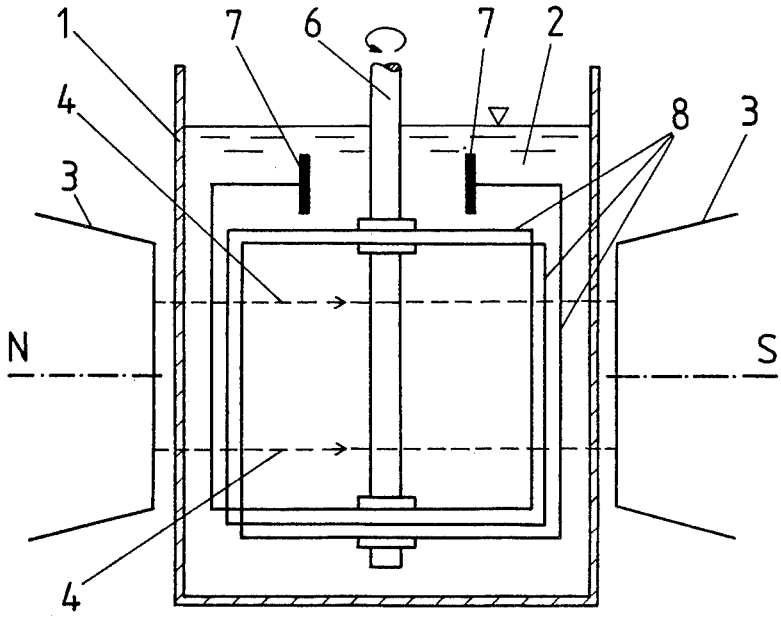
FIG. 2 shows a conductor arrangement in the form of a coil with several turns.

FIG. 2 shows a conductor arrangement in the form of a multi-turn coil. The reference numbers correspond to those of FIG. 1, with the exception of the open conductor loop 5, which is replaced here by the conductor coil 8. Of course, the individual turns of this coil must be electrically insulated from each other and from the electrolyte 2. By the presence of several turns the electromotive force available for the electrolysis is multiplied and the capacity correspondingly raised.

The considerations presented in connection with FIG. 1 concerning rectification, magnetic field arrangement and super-position of several magnetic fields hold in analogous manner for FIG. 2.

Figure 3:
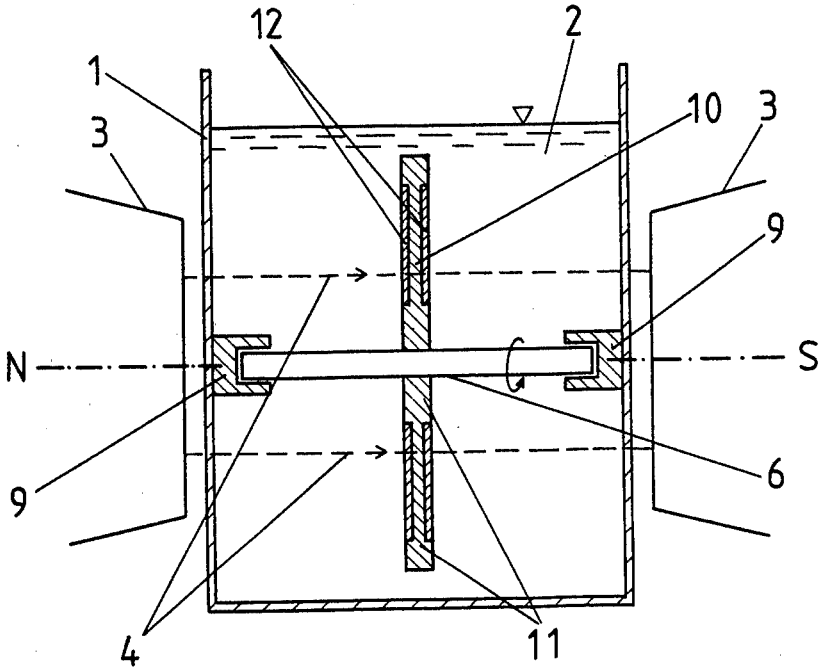
FIG. 3 shows a conductor arrangement in the form of a unipolar disk.

In FIG. 3 is shown a conductor arrangement in the form of a unipolar disk. The electrolysis receptacle 1 has two bearings 9 on its inner wall to receive the shaft 6 made of insulating material and carrying a conducting disk 10. The latter exhibits at its periphery and around its center, free surfaces each forming an annular electrode 11, while its intermediate portion is covered on each side by an annular insulator disk 12. The remaining reference numbers correspond to those of FIG. 1. The disk 10 is made to rotate via the shaft 6 by a rotary device not shown here. According to the unipolar principle a radially directed electric field is induced in it. The electromotive force acting between the center and periphery of the disk drives a corresponding direct current radially through the disk. The current circuit is closed in the reverse direction through the electrolyte. Such an arrangement is especially advantageous when only small voltage (some tenths of a volt) are needed, but high current strenghths are desired. This is generally the case in metal-refining processes. By suitable choice of the direction of rotation of the conducting disk 10 with respect to the direction of the magnetic field lines 4 the polarity can be established so that the periphery of the disk 10 becomes either anode or cathode.

The receptacle 1 does not have to have a circular cross section but can just as well be rectangular. Further, the conducting disk 10 can also have another profile and the annular insulator disks 12 can be replaced by suitable coatings of corrosion-resistant films (e.g. insulating lacquers based on phenol resins, thermoplastics, thermosetting plastics, etc.).

Figure 4:
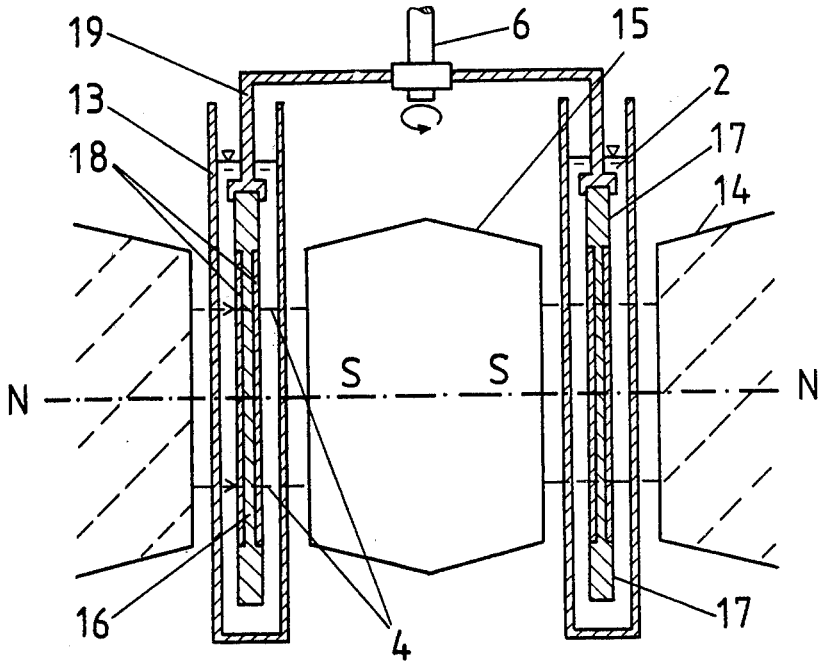
FIG. 4 shows a conductor arrangement in the form of a unipolar cylinder.

In FIG. 4 is shown a conductor arrangement in the form of a unipolar cylinder. In an annular electrolysis receptacle 13 a conducting hollow cylinder 16 is rotated by means of a shaft 6 via an intermediate drive member 19 of insulating material. The greatest part of the hollow cylinder 16 is covered on each side by insulating cylinders 18, so that only the cylindrical electrodes 17 are in contact with the electrolyte 2. The magnetic field lines 4 pass radially through the electrolysis receptacle and the hollow cylinder 16 and induce in the latter an electrical field along its length. The current produced by the driving electromotive force is available for charge-carrier transport in the electrolyte on both sides of the insulating cylinders 18 along their length. The magnet system is formed by a radially magnetized ring magnet 14 and a likewise magnetized cylinder magnet 15. The required magnetic return path between ring and cylinder magnet is left out of this figure for the sake of clarity. With respect to the insulator cylinders 18, what was said about the insulator disks 12 in FIG. 3 holds here also. The hollow cylinder 16 can obviously also be replaced by a conical or truncated conical shell, leading, of course, to other receptacle shapes.

This arrangement is suited mainly for higher capacities with respect to both voltage and current strengths, since there is hardly a limit to the choice of cylinder dimensions. Besides, the compact construction of the intermeshing coaxial magnet bodies permits the realization of a narrow active annular gap and an improved space utilization by the magnet system. This also results in a higher energy efficiency and a better current yiield, whereby the higher technological cost entailed by an annular receptacle may be justified.

Figure 5:
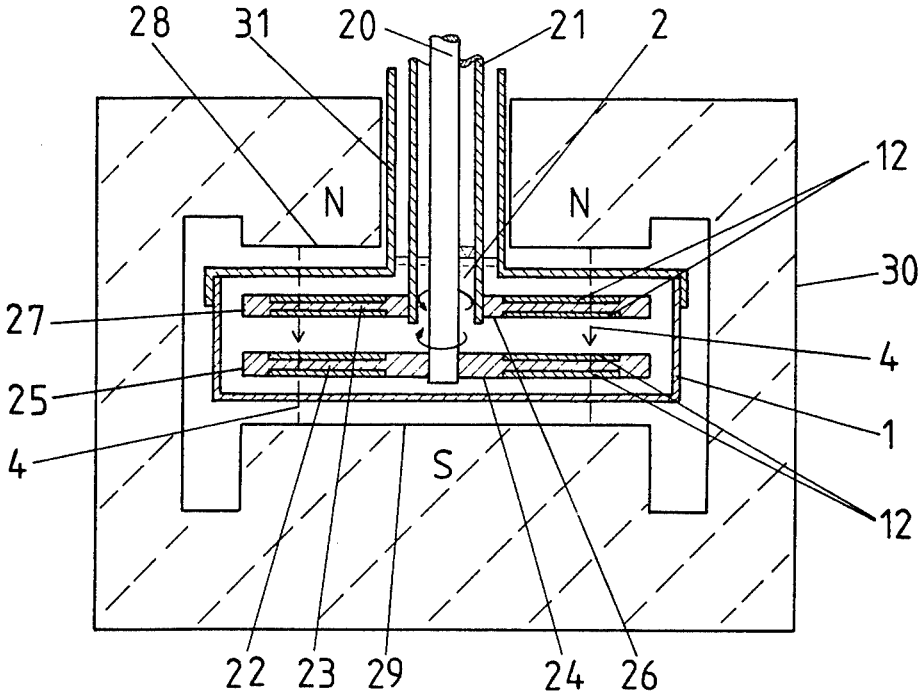
FIG. 5 shows a conductor arrangement in the form of two counterrotating unipolar disk.

FIG. 5 shows a conductor arrangement in the form of two counterrotating unipolar disks in vertical-axis construction. Two horizontal unipolar disks are situated in a cell closed on all sides in the form of a cylindrical electrolysis receptacle 1 and a cover 31. Fastened to the end of the inner shaft 20 is the lower conducting disk 22 with the annular inner electrode 24 and the annular outer electrode 25. The upper conducting disk 23 with its annular electrodes 26 (inner) and 27 (outer) is mounted on the coaxially arranged hollow shaft 21. The cell is symmetrically enclosed on all sides by a magnet system composed of the upper annular 28 and the lower cylindrical 29 pole shoes as well as the yoke 30 representing the magnetic return path. The yoke 30 and any intermediate parts not illustrated are preferably made of soft iron. The field lines 4 pass axially parallel through the electrolyte 2 and induce oppositely directed radial electromotive forces in the oppositely driven disks 22 and 23. Because of the small ohmic resistance of the electrolyte between the closely spaced disks 22 and 23, the current circuit is closed predominantly via the pairs of opposed electrodes 24 and 26, 27 and 25, while practically no current flows radially in the electrolyte. The electromotive forces induced in disks 22 and 23 are thus connected in series, while at the same time the current paths in the electrolyte are considerably shortened compared to the single-disk arrangement. Apart from the advantage of greater power transfer and better space utilization, the configuration offers short transport paths for the charge carriers in the electrolyte, which approach very closely those of conventional static cells. By radial division of the magnet system into separate segments the apparatus can be made suitably demountable, so that the cathodic deposits can quickly be removed from the disks or the latter can be replaced with new ones.

Figure 6:
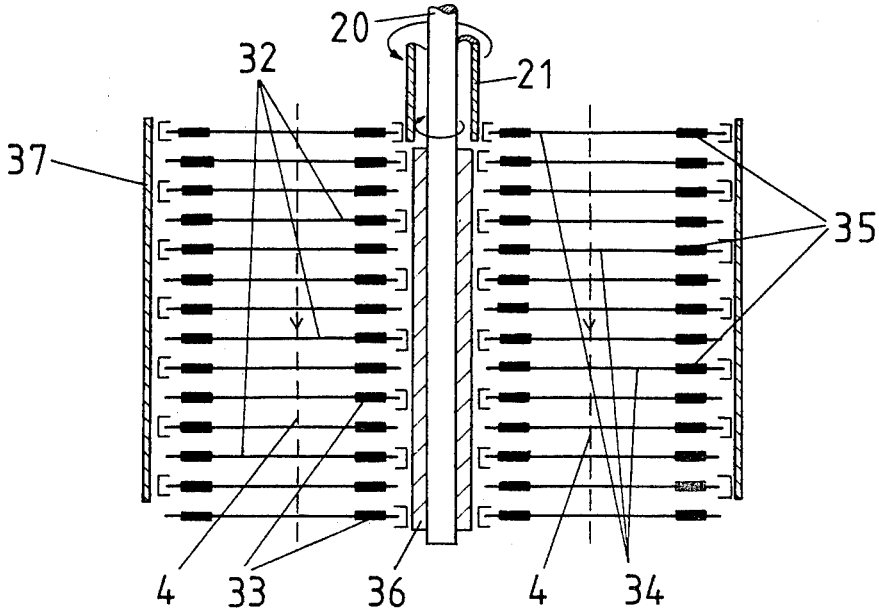
FIG. 6 shows a conductor arrangement in the form of several counterrotating unipolar disks.

FIG. 6 represents schematically a conductor arrangement in the form of several counterrotating unipolar disks. This figure is thus closely related to the preceding one, where, however, the magnet system has not been shown for the sake of clarity. Clockwise-turning conducting disks 32 with their inner electrodes 33 are attached to an inner tube 36 of insulating material driven by the inner shaft 20. This system is interleaved with a similar system of counterclockwise turning conducting disks 34 with outer electrodes 35 and mounted on an outer cylinder 37 driven by the hollow shaft 21. The disks are penetrated perpendicularly by the axially parallel magnetic field lines 4. This arrangement is distinguished by large electrode areas, small specific volume of electrolyte and compact construction. The remarks concerning FIG. 5 hold here also.

Figure 7:
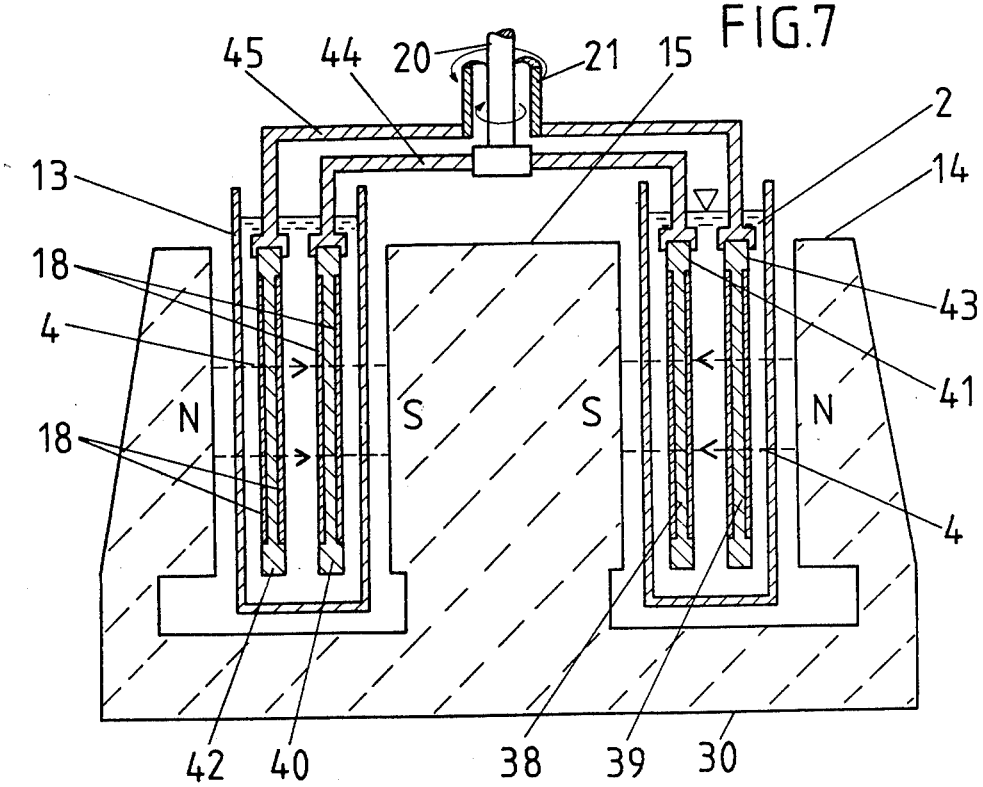
FIG. 7 shows a conductor arrangement in the form of two counterrotating unipolar cylinders.

FIG. 7 shows a conductor arrangement in the form of two counterrotating unipolar cylinders. In an annular electrolysis receptacle 13 are situated two vertical-axis unipolar cylinders. The inner conducting hollow cylinder 38 with the lower electrode 40 and the upper electrode 41 is fastened to the shaft 20 via the inner drive member 44 of insulating material. The outer conducting hollow cylinder 39 with the lower electrode 42 and the upper electrode 43 is mounted to the outer drive member 45 which is attached in turn to the hollow shaft 21. The other component parts and reference numbers correspond to those of FIGS. 4 and 5. The magnetic field lines 4 pass through the conducting hollow cylinders 38 and 39 and generate in them electromotive forces in opposite directions along their lengths. The considerations brought out in connection with FIG. 5 hold here also in an analogous manner. The capacity can be further increased in proportion to greater conductor and electrode area.

Figure 8:
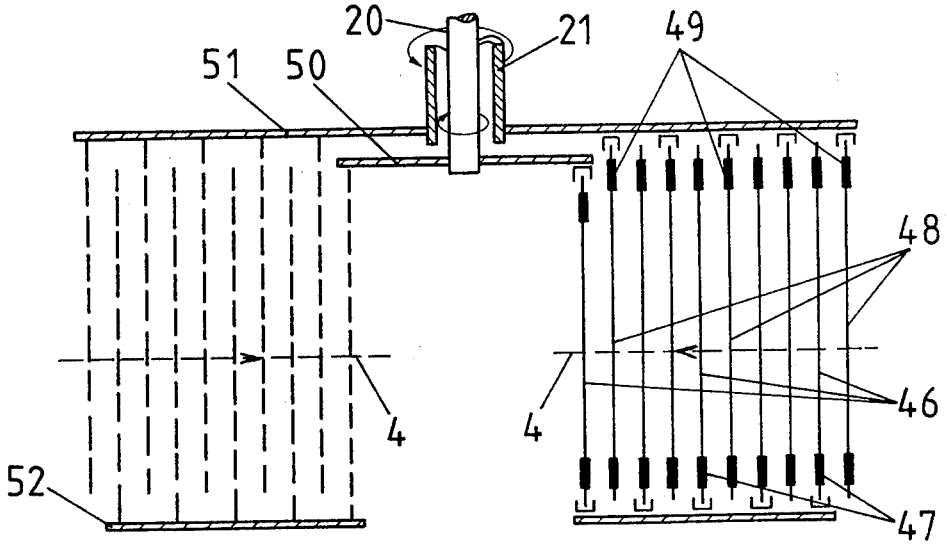
FIG. 8 shows a conductor arrangement in the form of several counterrotating unipolar cylinders.

A conductor arrangement in the form of several counter-rotating unipolar cylinders in schematically represented in FIG. 8. This arrangement is an extension of the foregoing one in FIG. 7. Here, again, the magnet system is left out for the sake of simplicity. There are two systems of conducting cylinders, a clockwise-turning one 46 and a counterclockwise turning one 48. The lower electrode of a clockwise rotating cylinder is denoted by 47, the upper electrode of a counterclockwise rotating cylinder, by 49. The opposite electrodes are constituted similarly but are not expressly indicated by numbers here. The counterclockwise-rotating cylinders 48 are suspended from the upper drive disk 51 made of insulating material, which is driven in turn by the hollow shaft 21. The innermost clockwise rotating cylinder 46 is mounted on the lower drive disk 50 which is flanged to the shaft 20. This innermost cylinder in turn carries the bottom mounting disk 52 of insulating material, on which the remaining clockwise-rotating cylinders 46 are held. The magnetic field lines pass radially through the cylinders. By this arrangement the conductor and electrode areas are multiplied, so that large electrolysis capacities are possible. Obviously, what was said with respect to FIG. 7 also holds true here.

Special attention must be called here to the fact that through the rotation of the conductor arrangement, particularly in the case of disks, a strong pumping or stirring action is produced in the electrolyte, since the fluid portions near the disks are accelerated radially outwards. Excellent mixing of the electrolyte is thereby guaranteed and in certain cases, in addition, special effects can be obtained, in that the course of the reaction at the electrodes can be additionally controlled.

The invention is not limited to the described forms of embodiment. In particular, the disks and cylinders can also be perforated or open in structure, so that spoked or cage-like configurations may serve as conductor arrangements. In certain cases such arrangements can have the advantage of preventing eddy currents and other harmful side effects. The same holds for the annular electrodes which, to increase the turbulence (gas bubbles, dissolved substances), can be radially or axially slotted or otherwise subdivided.

Figure 9:
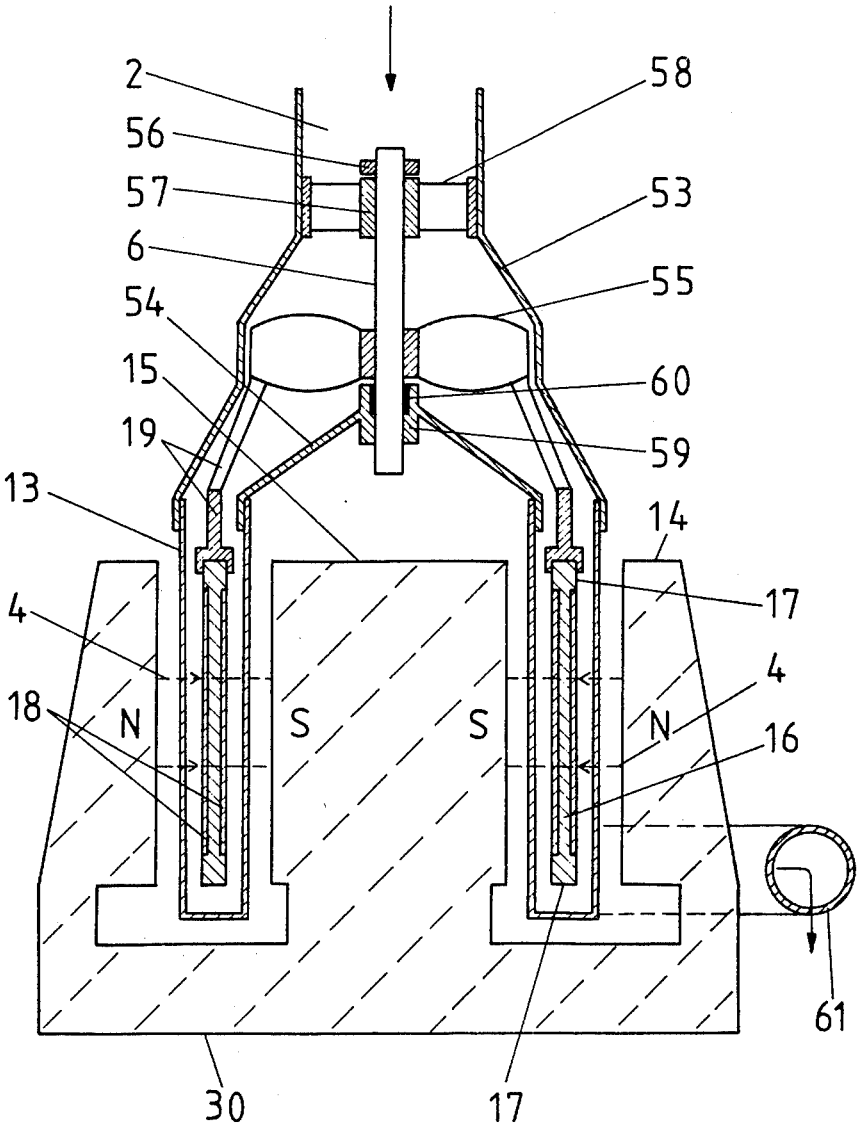
FIG. 9 shows an arrangement with a unipolar cylinder driven by the flowing electrolyte via an axial-vane wheel.

In FIG. 9 is shown an arrangement with a unipolar cylinder driven by the flow of electrolyte through an axially vaned wheel. The flow energy of the electrolyte is thereby hydrodynamically utilized to make the conductor arrangement rotate. An annular pressurized electrolysis receptacle 13 is enclosed on all sides by an outer shell 53 and an inner shell 54. The electrolyte 2 is introduced from above, flows between the guide vanes of the bearing support 58 and then through the propeller wheel 55 made of insulating material. The latter is mounted on the shaft 6 which in turn is secured in the overhead support bearing 57 by means of bearing ring 56 and fitting into the guide bearing 59 with stuffing box 60. The torque is transmitted to the conducting hollow cylinder 16 via an intermediate member 19 made of perforated insulating material. The electrolyte leaves the apparatus via the drain pipe 61. The remaining component elements and reference numbers correspond to those of FIGS. 4 and 7. Such arrangements are called for, above all, when large quantities of electrolyte under rather high pressure are available, the hydraulic potential energy of which can be used.

Figure 10:
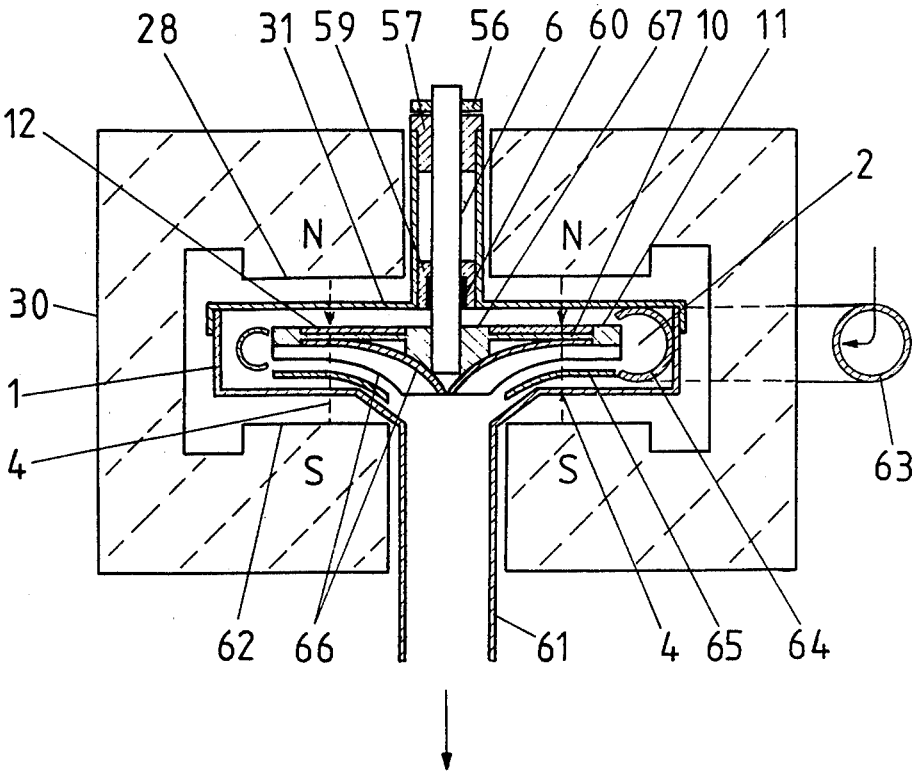
FIG. 10 shows an arrangement with a unipolar disk driven by the flowing electrolyte via a radial-vane wheel.

FIG. 10 shows an arrangement with a unipolar disk driven by the flow of the electrolyte over a radially vaned wheel. The electrolysis receptacle 1 is disk shaped and has a cover 31. The electrolyte 2 is brought in to the radial-vane wheel 66 via the inlet pipe 63 and the inlet spiral 64 of insulating material mounted inside the receptacle 1. Said wheel 66 is fastened to the front side of the conducting disk 10 and is likewise made of insulating material. The disk 10 at its outer periphery becomes the annular electrode 11 and at its inner portion, the hub electrode 67 and is fastened to the shaft 6. The latter is furnished with a bearing ring 56 and rotates in an overhead support bearing 57 as well as in a guide bearing 59 with stuffing box 60. The space under the radial-vane wheel 66 is bounded by a funnel-shaped shell 65 of insulating material for directing the flow of electrolyte. The magnetic field lines 4 emerge from the annular upper pole shoe 28, pass through the disk 10 and the radial-vane wheel 66 and enter the lower pole shoe 62, whereupon they close upon themselves via the yoke 30. The electrolyte leaves the apparatus through the central vertical drain pipe 61 which can also have the shape of a diffuser. The conducting disk 10 and the radial-vane wheel 66 can also have a different form from that of FIG. 10. In particular, these two components can even be made of a single piece or be otherwise integrated, as long as the metallic surfaces in the middle portion between hub and periphery are covered by an insulating coating. This arrangement combines the dynamoelectric principle with that of electrolysis and that of the Francis turbine. It can find application mainly when there is a suitable hydraulic potential (sizeable quantity of liquid, high pressure) of the electrolyte.

Example I of the Method 3.0 g of silver nitrate ($AgNO_3$) were dissolved in 60 ml of water and this electrolyte was put in a 100 ml wide-neck flask. A coil of 20 turns was made from insulated copper wire of 1 mm diameter so as to form a rectangular frame 30 mm wide by 60 mm high. The beginning and end of this coil were bared along 20 mm lengths which served as electrodes. The coil was symmetrically fastened to a glass rod, acting as a shaft, with its 60 mm length parallel to the shaft. The wide-neck flask filled with electrolyte was placed between the poles of an unexcited Newport Instruments electromagnet of 10 cm pole diameter and 8 cm pole separation. Then the shaft with the coil on it was introduced vertically into the electrolyte container and fixed rotatably on a stand (cf. FIG. 2). By means of a flexible shaft the coil was set in rotation and held at 3000 rpm for 2 min. After this time no electrolytic action could be detected at the bare wire-ends serving as electrodes. The magnet was then turned on and set to an air gap induction of 3200 G. After a further 2 min. of rotation whisker-like deposits of silver could be detected at the electrodes, while additional powdery silver particles were suspended in the electrolyte. During an electrical half-period the silver ion was thus reduced at the electrode acting as cathode at that time, while its redissolution at the anode evidently occurred only partially or not at all. The yield of silver after 2 min amounted to about 50 mg.

Example II of the Method 3.0 g of copper sulfate ($CuSO_4$) were dissolved in 60 ml of water. This electrolyte was subjected to an electrolysis process analogous to that in Example I. Here, one conductor end was bare copper wire (1st electrode) while the other was a bare silver wire (2nd electrode). After a 1 min test duration with the magnet turned on, a distinct copper deposit was detectable on the silver electrode.

Example III of the Method

Into a 100 ml wide-neck flask were put 60 ml of 5% potassium hydroxide (KOH) which contained, in addition, 10% ethanol ($C_2H_5OH$). The coil of Example I was then altered in that the electrodes were now 15 mm-long pieces of nickel wire instead of the bare copper wire ends. After a 5 min test duration under the conditions of Example I the solution had become light yellow in color, which can be ascribed to the dissolving of nickel. There was detected in the solution, further, by means of gas chromatography a fraction of about 1% acetic acid ($CH_3COOH$) referred to ethanol (about 0.1% referred to total electrolyte). The acetic acid had been formed by anodic oxidation of the ethanol at the nickel electrodes. This electroorganic reaction is practically irreversible, i.e. acetic acid once formed cannot again be reduced. The reaction taking place simultaneously at the electrode acting as cathode is hydrogen formation.

By the method and arrangements of the invention, electrolysis processes are made possible avoiding any direct external energy supply. By the completely contact-free power transmission through induction, all problems of external current input disappear. Thanks to this independence every electrolysis cell can be optimally constructed for its special purpose, whereby the advantage of rotating electrodes with respect to material transport, uniformity of current and voltage distribution can only now be fully exploited. This is true above all for electroorganic processes and for the treatment of waste liquor and waste water and for all cases where very high selectivity of the extraction is demanded.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of carrying out an electrolysis process in an electrolytic cell containing an electrolytic medium by the use of electromotive induced cell voltage as the only source of the cell voltage which is necessary to be applied between an anode and a cathode of the cell to create electrolysis, said method including the steps of:
   - placing a solid electron conductor in the form of a conducting body and having electrodes into said cell;
   - passing a magnetic field transversely through said cell;
   - and varying the part of said magnetic field which is acting upon said electron conductor;
   - whereby a voltage is induced in said electrodes.

2. The method of claim 1, wherein said magnetic field is stationary and fixed in space and said conductor is moved in said cell to vary the part of said magnetic field which is acting upon said conductor.

3. The method of claim 1, wherein said conductor remains fixed in position in said cell and said magnetic field is moved in space to vary the part of said magnetic field which is acting upon said conductor.

4. The method of claim 1, wherein both said magnetic field and said conductor move to vary the part of said magnetic field which is acting upon said conductor.

5. The method of claim 1, wherein said magnetic field is an alternating field and wherein a speed of rotation synchronous with said alternating field is imparted to said conductor.

6. The method of claim 1, wherein said magnetic field is composed of at least one stationary field fixed in space and at least one rotating field and wherein said conductor is moved indirectly by said rotating field.

7. The method of claim 1, wherein said electromotive force is produced in a wire loop consisting of at least one insulated turn subjected to a rotary motion in said magnetic field with electrodes connected to said loop's open ends.

8. The method of claim 7, wherein the primary alternating voltage produced as electromotive force is changed to dc voltage by a rectifier in the current path of said wire loop.

9. The method of claim 7, wherein the primary ac voltage produced as electromotive force is at least partly rectified by at least partially irreversible electrode reactions.

10. The method of claim 7 wherein the primary ac voltage produced as electromotive force is at least partly rectified by an asymmetric configuration of said electrodes.

11. The method of claim 1, wherein the electromotive force is produced as dc voltage in an electron conducting disk subjected to rotary motion in said magnetic field.

12. The method of claim 1, wherein said electromotive force is produced as dc voltage in an electron conducting cylinder subjected to a rotary motion in said magnetic field about an axis parallel to said field.

13. The method of claim 1 wherein said electrolytic medium is an aqueous solution.

14. The method of claim 1 wherein said electrolytic medium is an organic solution.

15. The method of claim 1 wherein said electrolytic medium is a melt.

16. The method of claim 1 wherein said electromotive force is produced as dc voltage in an electron conducting cone subjected to rotary motion in said magnetic field.

17. An apparatus for carrying out an electrolytic process, said apparatus comprising:
   - an electrolysis receptacle adapted to contain an electrolytic medium;
   - at least one electron conductor in said receptacle, each said conductor comprising a conducting body and including at least one anode and at least one cathode;
   - at least one magnet body adapted to produce a magnetic field within said receptacle; and
   - means for varying said magnetic field with respect to said electron conductor.

18. The apparatus of claim 17, wherein said magnet body is fixed in space, has two poles and consists of magnets and a yoke and intermediate parts made of soft iron serving to conduct the magnetic flux, and that said electron conductor consists of a wire loop of at least one turn driven by a rotary device, the axis of rotation of said wire loop being perpendicular to the magnetic field lines and the open ends of said loop being provided with electrodes in the form of said anode on one and said cathode on the other.

19. The apparatus of claim 17 wherein said magnet body has two poles and turns about an axis which is perpendicular to the magnetic field lines passing through said electrolyte, said magnet body being driven by a rotary device, and wherein said electron conductor consists of a wire loop of at least one turn fixed in space.

20. The apparatus of claim 18 or 19, wherein said electrodes are asymmetrically formed.

21. The apparatus of claim 18 or 19 wherein there is a rectifier within said electron conductor.

22. The apparatus of claim 17, wherein said magnet body has two poles and turns about an axis which is perpendicular to the magnetic field lines passing through said electrolyte, said magnet body being driven by a first rotary device, and wherein said electron conductor is driven by a second rotary device in a direction counter to that of said magnet body rotation.

23. The apparatus of claim 17, wherein said magnet body is fixed in space and has two poles and at least one exciter winding which is fed a varying current of constant frequency wherein the entire magnet body is built up of laminated soft iron, and wherein said electron conductor consists of a wire loop of at least one turn driven by a rotary device with a rate of rotation synchronous with the frequency of said varying current.

24. The apparatus of claim 17, wherein said magnet body is built up of two disk-shaped poles and a hollow cylindrical yoke and is fixed in space, and wherein said electron conductor consists of at least one circular disk driven by a rotary device, the rotation axis of said disk is parallel to the magnetic field lines, and both sides of each disk are at least partially coated with an insulating layer so that the inner portion of said disk forms one electrode and the outer portion forms the other.

25. The apparatus of claim 24, wherein said conductor in the form of a circular disk is provided on one side with a radial-vane wheel through which said electrolyte itself flows and which serves to drive said disk.

26. The apparatus of claim 24, wherein said electron conductor consists of two groups of parallel circular disks driven in opposite directions by separate rotary devices, the magnetic field lines of said magnet body passing perpendicularly through the disk surfaces in succession.

27. The apparatus of claim 24 wherein said conductor is in the form of a circular disk composed of a radial vane wheel provided with an inlet spiral and a funnel shaped sheet, said spiral and sheet acting to direct said electrolyte whose flow drives said disk.

28. The apparatus of claim 17, wherein said magnet body is made up of a cylindrical inner pole and a hollow cylindrical outer pole with radial magnetization direction and a disk-shaped yoke and is fixed in space, and that said electron conductor arrangement consists of at least one cylindrical body driven by a rotary device and having its axis of rotation perpendicular to the planes of the magnetic field lines passing radially through said electrolyte, and that said electrolyte receptacle is annular.

29. The apparatus of claim 28, wherein said conductor in the form of a cylinder is driven via an intermediate member from a coaxial propeller wheel through which said electrolyte itself flows.

30. The apparatus of claim 28, wherein said electron conductor consists of two groups of coaxial cylindrical bodies driven in opposite directions by separate rotary devices.

31. The apparatus of claim 17, wherein said magnet body has means for production of both a stationary field fixed in space and an additional rotating field and that said rotary device consists of said conductor itself, its support and its electromagnetic coupling with said rotating field.

* * * * *